United States Patent [19]

Taniguchi et al.

[11] 3,991,697

[45] Nov. 16, 1976

[54] TWIN-SCREW VESSEL

[75] Inventors: Kaname Taniguchi; Kinya Tamura, both of Nagasaki, Japan

[73] Assignee: Mitsubishi Jukogyo Kabushiki Kaisha, Japan

[22] Filed: Oct. 15, 1969

[21] Appl. No.: 866,478

[30] Foreign Application Priority Data

Oct. 26, 1968 Japan ..... 43-77668

[52] U.S. Cl. ..... 114/57; 114/162; 115/37

[51] Int. Cl.[2] ..... B63B 1/08

[58] Field of Search ..... 114/57, 162, 163, 165, 114/167, 169, 166; 115/37

[56] References Cited

UNITED STATES PATENTS 3,416,480 12/1968 Pien ..... 114/57

FOREIGN PATENTS OR APPLICATIONS 613,208 5/1935 Germany ..... 114/57

*Primary Examiner*—Trygve M. Blix
*Assistant Examiner*—Sherman D. Basinger
*Attorney, Agent, or Firm*—McGlew and Tuttle

[57] ABSTRACT

A ship construction comprises a symmetrical hull having two screw propellers which are symmetrically arranged in respect to the longitudinal central plane of the hull. A rudder is mounted aft of the screw propellers and preferably in the central plane. The propellers and the rudder are so dimensioned that the diameter of each propeller is less than the spacing between the center lines of the two propeller shafts. In addition, the distance between the axes of the propellers is equal to or less than the diameter of each propeller plus the thickness of the rudder. The arrangement provides an improved propulsive efficiency without loss in maneuverability.

1 Claim, 6 Drawing Figures

TWIN-SCREW VESSEL

SUMMARY OF THE INVENTION

This invention relates in general to ship construction and, in particular, to a new and useful twin-screw ship and to an improved propeller and rudder arrangement therefor.

In a conventional twin-screw ship, it is usual to provide a screw propeller in a symmetrical arrangement on each side of the longitudinal central plane of the ship and one rudder is provided for each screw, located directly aft of the associated screw. This is because if a single rudder only is placed symmetrically in respect to the hull along the central longitudinal plane and between the screw propellers, there will be a loss of maneuverability. Therefore, it has been regarded as a common expedience to adopt a construction in which a rudder is oriented behind each screw propeller. This is particularly true in respect to large and full ships which are characterized by poor manueverability.

It is generally desirable with very large and full ships to operate them at speeds which are not greater than the speeds of ships of ordinary size and, therefore, their propellers are not so large as those of ordinary ships. On the other hand, it is generally desirable that their rudders should be increased in area nearly in proportion to the size of the hull. In addition, the thickness of the rudders must also be increased in view of the strength requirements for such large ships. This means that the rudders are comparatively large in respect to the screw propellers and, therefore, the thrust deduction fraction increases. The increase of the thrust deduction fraction means the decrease of propulsive efficiency. Accordingly, the twin-screw twin-rudder system has a defect that the propulsive efficiency is poor although the maneuverability remains comparatively good.

In accordance with the present invention, there is provided an improved twin-screw ship which has improved propulsive efficiency without loss in maneuverability, and this is achieved by the arrangement and sizing of the propellers and rudder in accordance with the invention.

A twin-screw ship of the present invention is characterized by the symmetrical arrangement of a screw propeller on each side of the longitudinal plane and in respect to a single rudder disposed along this plane. The propeller arrangement and the rudder sizing is such that the diameter of each propeller is less than the spacing between the center lines of the propeller shafts, but the spacing is equal to or less than the diameter plus the thickness of the rudder.

Accordingly, it is an object of the invention to provide an improved twin-screw ship construction having an improved propulsive efficiency without loss in maneuverability.

A further object of the invention is to provide an improved ship construction which includes a screw propeller arranged at the spaced location from each side of the longitudinal central plane of the ship's hull in a symmetrical arrangement forward of a rudder, and wherein the rudder and the ship's screw propeller diameters and spacing is such that the diameter is less than the spacing between the axes of the screw propellers and the spacing is equal to or less than the diameter of each propeller plus the thickness of the rudder.

A further object of the invention is to provide a ship hull construction which is simple in design, easy in construction and economical to manufacture.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

GENERAL DESCRIPTION OF THE PREFERRED EMBODIMENTS

Figure 1:
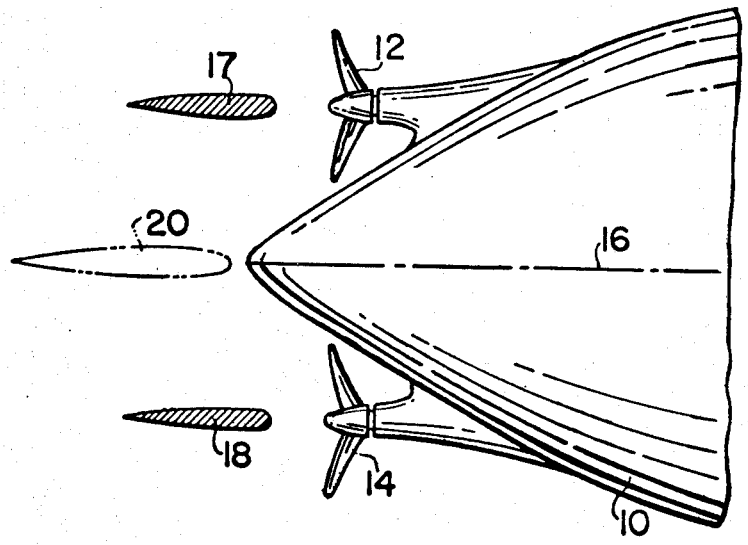
FIG. 1 PRIOR ART
FIG. 1 is a horizontal cross sectional view of a stern portion of a conventional twin-screw ship of the prior art.
Figure 5:
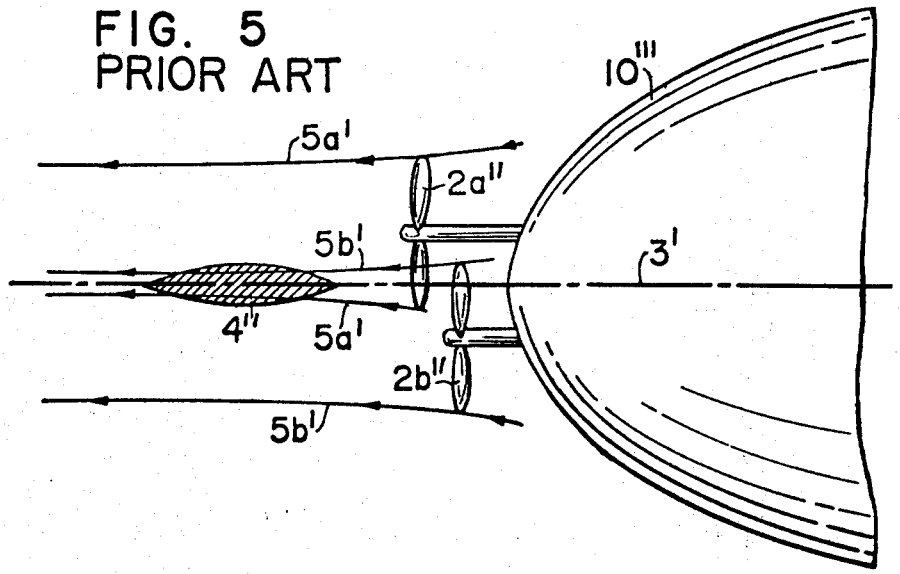
FIG. 5 PRIOR ART
FIG. 5 is a schematic view of the flow pattern around the ship's stern with propellers in an overlapping arrangement.
Figure 6:
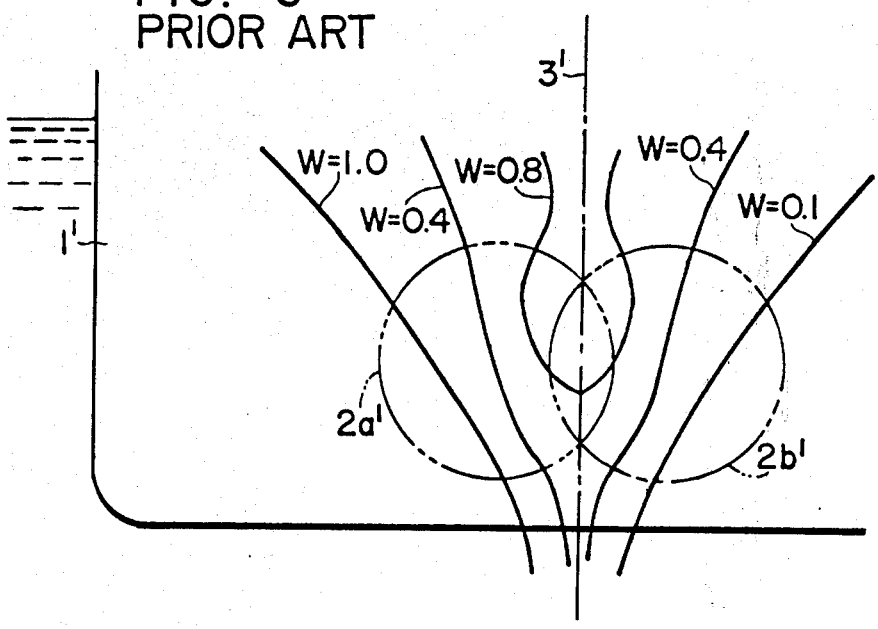
FIG. 6 PRIOR ART
FIG. 6 is a transverse cross sectional view of the flow pattern around the ship's stern with propellers in an overlapping arrangement.

The prior art is indicated in FIG. 1 and also in FIGS. 5 and 6. The usual construction of a twin-screw ship is shown in FIG. 1. In this arrangement a symmetrical twin-screw ship includes a hull 10 having screw propellers 12 and 14 symmetrically arranged on respective sides of a longitudinal central plane 16. Rudders 17 and 18 are associated with and arranged aft of the respective screws 12 and 14 and are symmetrically arranged in respect to the central plane 16. The rudders 17 and 18 are provided just behind the associated screw propellers 12 and 14 and one rudder is provided for each screw propeller rather than an arrangement of a central rudder 20 shown in dotted lines in FIG. 1. This is because a rudder position on the central plane 16 would not permit easy maneuverablility and for large and full ships, it is essential to employ this two-rudder arrangement as indicated at 17 and 18 up to the time of the present invention.

Figure 2:
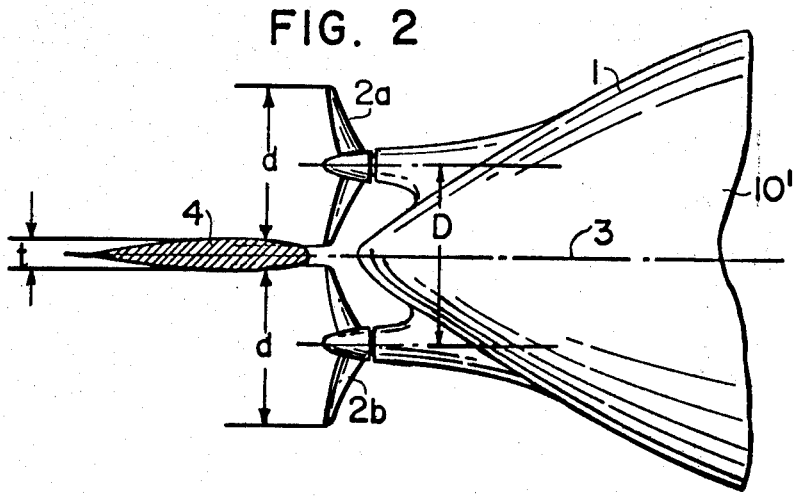
FIG. 2 is a horizontal cross sectional view similar to FIG. 1, but showing a construction in accordance with the invention.
Figure 3:
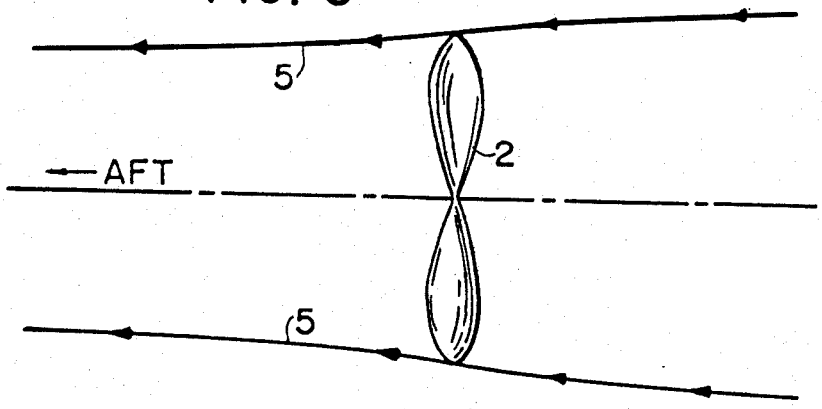
FIG. 3 is a schematic indication of the flow pattern around a single propeller.
Figure 4:
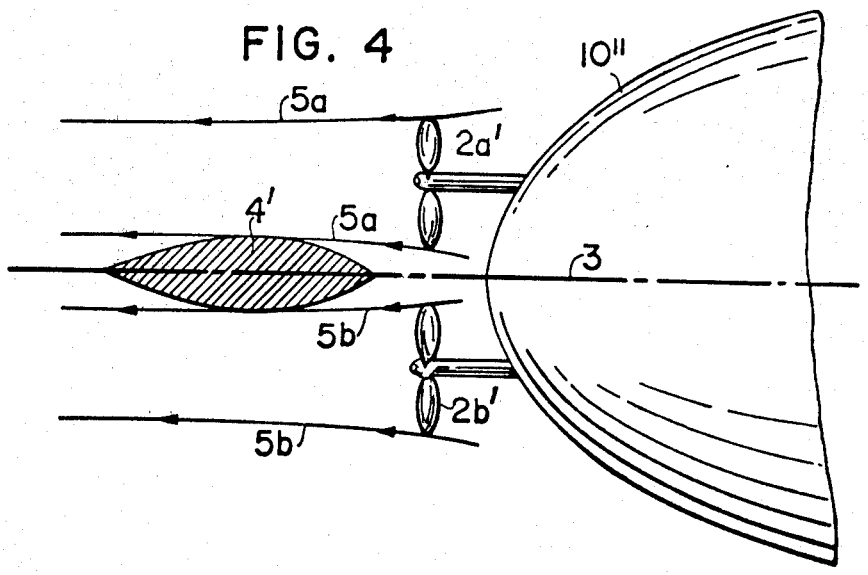
FIG. 4 is a schematic view of the flow pattern around the ship's stern of a ship constructed in accordance with the invention.

In accordance with the invention as shown and described in FIGS. 2–4, the ship's hull 10′ is provided with a stern 1 having screw propellers **2*a* and 2*b* which are symmetrically arranged in respect to a longitudinal central plane 3. A rudder 4 is provided on the central plane 3 and is located aft of the screw propellers 2*a* and 2*b*. In accordance with the invention, the screw propellers 2*a* and 2*b*** are arranged with a spacing at D between their axes which is greater than the diameter *d* of each screw propeller. This spacing D is not greater than the diameter of each propeller plus the thickness t of the rudder 4, that is, the spacing D may be equal to or less than the diameter of each screw propeller plus the rudder thickness *t*.

The above construction provides an improved propulsive efficiency and rudder control for increased maneuverability. As indicated in FIG. 3, a general flow pattern around a single propeller 2 is indicated by a tubular formation 5 shown by the arrows in FIG. 3. The flow stream flows in the direction of the arrows aft. This tubular flow formed by the stream lines passes through the circumference of the propeller disc 2 and the region inside this tube includes a stream which is accelerated by a propeller and in the region outside this tube a stream is little accelerated. The diameter of the tube 5 aft of the propeller becomes smaller than the diameter of the propeller since contraction occurs in the accelerated stream.

In the case of the twin-screw ship 10'' which is contructed in accordance with the invention as indicated in FIG. 4, the flow around the propellers 2*a*' and 2*b*' produces the tubular flow indicated by the arrows 5*a* and 5*b*, respectively, which contracts in an aft direction toward the rudder 4'. Because of the clearance between the two propellers 2*a*' and 2*b*', and because of the contraction of the accelerated stream, the accelerated stream of each propeller will flow independently behind the associated propeller without interfering with each other. The respective accelerated streams will flow near the surface of the rudder 4' which is located on the central plane 3 of the hull of the ship 10''.

Thus, the invention of the present case as described in association with FIGS. 3 and 4, has the following beneficial effects: first of all, as the accelerated streams do not dash against the rudder 4', the thrust deduction fraction is smaller than that of the ordinary twin-screw and twin-rudder ship. However, as the propellers 2*a*' and 2*b*' are placed nearer the central plane 3 of the hull of the ship 10'', the wake fraction increases and the propulsive efficiency increases.

As a second characteristic in respect to maneuverability, the rudder 4' is placed near the accelerated streams of each propeller 2*a*' and 2*b*' so that it will act efficiently in the accelerated stream even if the rudder angle is very small. In the case of a large rudder angle, the accelerated stream of the associated propeller will dash wholly against the rudder and the effect of the movement of the rudder will become large and, thus, the maneuverability will be improved.

In model tests in a towing tank applying the present invention arrangement to a 320 thousand dead weight ton tanker, the propulsive efficiency is found to be improved by about 10 percent compared with the conventional twin-screw, twin-rudder system while the maneuverability is of the same order.

There are some proposals which resemble the present invention and aim to improve the propulsive efficiency by arranging the propellers such that they have a mutual influence at an overlapping of the accelerated streams. This is achived by making the propeller diameter greater than the spacing between the axes of the propeller shafts as indicated at FIG. 5. In the case of the overlapping propeller, the accelerated streams which are bounded by the tubular contracted streams designated 5*a*' and 5*b*', respectively, are also overlapped. This overlapping of the accelerated streams makes the flow uniform so that the slow flow region near the central plane 3' of the hull 10''' may be doubly accelerated by both propellers.

However, in model experiments the overlapping propeller arrangement contemplated by FIG. 5 shows almost the same propulsive efficiency as the present invention but the flow behind the ship is not so simple as it has been thought. One of the results of the experiments as indicated in FIG. 6, shows that the velocity distribution at the propeller position as measured without propellers varies as indicated. In FIG. 6 W indicates the wake fraction as defined by $W = 1 - (v'/vs)$. $Vs$ is the ship speed and $v'$ is the local velocity relative to the hull.

As indicated in FIG. 6, the velocity distribution in the wake is very complicated and the velocity is slower near the central plane 3' of the hull 10'''. Overlapping propellers accelerate the slow flow but as shown in FIG. 6, it is impossible to accelerate the whole of them, so in overlapping arrangement, uniform flow will not be obtained. Since there is still some non-accelerated slow flow streams near the accelerated flow stream, there appears a rapid change in the inflow velocity to the propellers. This rapid change in the inflow velocity is likely to increase the vibratory forces which act due to the rotation of propellers. This leads to the possibility of cavitation because the vibratory forces of the propeller and the cavitation phenomena are mainly caused by the non-uniformity of the wake field.

In addition, as has been found, that the propellers are overlapped, there will be an inconvenience because one propeller cannot be removed without removing the other, and if these propellers are arranged in the same plane, then one of the propellers cannot be rotated without also rotating the other. When the propellers are not arranged in the same plane, the forward propeller must have a lower pitch than that of the aft propeller in order to maintain an optimum efficiency. This fact results in another complication in the design of such an arrangement.

Thus, the present arrangement wherein the propellers are not overlapped and the spacing between the axes if greater than the diameter of each propeller but not greater than the diameter plus the thickness of the rudder, a simple structure is maintained but the efficiency of the ship is increased without any detriment to the maneuverability.

In the drawings and description herein, the ship has been shown as being at least a twin-screw ship but it should be appreciated that the invention will be applicable in the case of a four-screw vessel in respect to the two shafts which are positioned toward the inside of the vessel.

What is claimed is:

1. A ship construction comprising a hull having a longitudinal central plane with a screw propeller rotatably mounted on an axis symmetrically arranged on each side of said central plane, a rudder aft of said screw propellers arranged on said central plane, said hull being shaped so that it does not protrude aft between said screw propellers, the distance between the axes of said screw propellers being greater than the diameter of each of said screw propellers and being equal to or less than the diameter of each of said propellers plus the thickness of said rudder.

* * * * *